US009183718B2

(12) United States Patent
Bergman et al.

(10) Patent No.: US 9,183,718 B2
(45) Date of Patent: Nov. 10, 2015

(54) SECURITY TAG DETACHER WITH USER-CONTROLLABLE DWELL TIME AND METHOD THEREFOR

(71) Applicants: Adam S. Bergman, Boca Raton, FL (US); Sergio Perez, Lake Worth, FL (US)

(72) Inventors: Adam S. Bergman, Boca Raton, FL (US); Sergio Perez, Lake Worth, FL (US)

(73) Assignee: Tyco Fire & Security GMBH, Rheinfall (CH)

( * ) Notice: Subject to any disclaimer, the term of this patent is extended or adjusted under 35 U.S.C. 154(b) by 137 days.

(21) Appl. No.: 14/189,204

(22) Filed: Feb. 25, 2014

(65) Prior Publication Data

US 2014/0240129 A1 Aug. 28, 2014

Related U.S. Application Data

(60) Provisional application No. 61/768,634, filed on Feb. 25, 2013.

(51) Int. Cl.

| | |
|---|---|
| ***G08B 13/14*** | (2006.01) |
| ***G08B 13/24*** | (2006.01) |
| ***E05B 73/00*** | (2006.01) |
| *E05B 47/00* | (2006.01) |

(52) U.S. Cl.

CPC ..... *G08B 13/2434* (2013.01); *E05B 73/0047* (2013.01); *E05B 47/0012* (2013.01)

(58) Field of Classification Search

USPC ..... 340/572.9, 572.3, 572.8

See application file for complete search history.

(56) References Cited

U.S. PATENT DOCUMENTS

| | | | | |
|---|---|---|---|---|
| 5,426,419 | A | 6/1995 | Nguyen et al. | |
| 5,528,914 | A | 6/1996 | Nguyen et al. | |
| 5,535,606 | A | 7/1996 | Nguyen et al. | |
| 5,955,951 | A | 9/1999 | Wischerop et al. | |
| 6,946,962 | B2 * | 9/2005 | Leone | G08B 13/2411 307/109 |
| 2005/0093699 | A1 * | 5/2005 | Leone | G08B 13/2411 340/572.3 |
| 2006/0080819 | A1 * | 4/2006 | McAllister | G06K 17/00 29/403.3 |

* cited by examiner

*Primary Examiner* — Travis Hunnings

(74) *Attorney, Agent, or Firm* — Robert J. Sacco, Esq.; Carol E. Thorstad-Forsyth, Esq.; Fox Rothschild LLP

(57) ABSTRACT

System for detaching an electronic article surveillance (EAS) tag includes a detaching element to selectively unlock a locking element of an EAS tag when the EAS tag is placed in a detachment position. A control system is arranged to cause the detaching element to transition from a deactivated state, in which the tag in the detachment position will remain locked, to an activated state in which the tag is unlocked. This transition will result in beginning or starting a dwell time. The control system is maintains the detaching element in the activated state while awaiting receipt from a user interface of a user manually initiated termination signal. The termination signal indicates a user intention to terminate the dwell time. In response to the termination signal, the control system causes the detaching element to transition from the activated state to a deactivated state.

16 Claims, 7 Drawing Sheets

SECURITY TAG DETACHER WITH USER-CONTROLLABLE DWELL TIME AND METHOD THEREFOR

CROSS REFERENCE TO RELATED APPLICATIONS

This application claims the benefit of U.S. Provisional Patent Application Ser. No. 61/768,634 filed Feb. 25, 2013, which is herein incorporated by reference.

BACKGROUND OF THE INVENTION

1. Statement of the Technical Field

This invention relates generally to security tags and associated detachers and, more particularly, to a security tag and a security tag detacher for use in an electronic article surveillance (EAS) system.

2. Description of the Related Art

Electronic article surveillance systems are well known in the art and are used for inventory control and to prevent theft and similar unauthorized removal of articles from a controlled area. Typically, in such systems a system transmitter and a system receiver are used to establish a surveillance zone which must be traversed by any articles being removed from the controlled area.

An EAS security tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS security tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

Attachment devices for EAS security tags include a wide variety of different latching mechanisms designed to prevent unauthorized personnel from removing the pin from the tag. The stimulus needed to unlatch an EAS security tag will depend upon the particular latching mechanism in use. Accordingly, a variety of different detaching units utilize various means to separate reusable, removable EAS security tags from articles of merchandise. Known systems for unlatching EAS security tags include devices generally involve the application of a force to certain latching components. The force can be applied directly to latching components by means of a mechanical element (e.g. by means of a probe inserted into the tag). Other detaching systems have powerful magnets which apply a magnetic force to latching components, thereby unlatching the tag. The mechanical and magnetic detaching methods are the two main types of systems commonly used with hard EAS security tags. Regardless of how the force is applied, the result is a disengagement of a latching element with an attachment pin in the tag, thereby allowing the tag to be removed from the article.

In tags which require a magnetic stimulus for unlatching, the latching mechanism (such as a moving clamp or pin) is usually made with a magnetic material such as carbon steel. Upon exposure to a magnetic field from a detacher unit, part of the clamp is attracted to the detacher. This movement of the latching components allows the pin of an EAS tag to be unlocked from the tag housing, thereby allowing the item to which the tag was attached to be removed from the store without setting off an alarm. In order to prevent illegitimate tag detachment using a commonly available magnet, the tag's clamp is typically designed such that it can only be opened when exposed to an unusually high magnetic field.

In the case of tags which are designed for unlatching in response to a mechanically applied force, a detacher probe structure is often used to interact with the tag. Examples of these types of mechanical detaching units are disclosed in U.S. Pat. Nos. 5,426,419; 5,528,914; 5,535,606, and 5,955,951. (The disclosures of these patents are incorporated herein by reference.). The detaching unit is operated to insert a probe or hook into the enclosure portion of the tag to release a latch or clamp. The pin may then be released from the enclosure portion of the tag, and the tag removed from the article of merchandise.

SUMMARY OF THE INVENTION

Embodiments of the invention concern a method for detaching an electronic article surveillance (EAS) tag from an article. The method can involve positioning an EAS tag in a detachment position in which a locking element of the tag is responsive to being unlocked by a detaching element of a tag detaching device. The method continues by causing the detaching element to transition from a deactivated state in which the tag in the detachment position will remain locked, to an activated state in which the tag is unlocked to begin a dwell time. The detaching element is maintained in the activated state while awaiting receipt from a user interface of a user manually initiated termination signal indicating a user intention to terminate the dwell time. Responsive to the termination signal, the method further involves transitioning the detaching element from the activated state to a deactivated state. The tag can be removed from the detaching position after the detachment process is complete.

The invention also concerns a system for detaching an electronic article surveillance (EAS) tag from an article. The system includes a detaching element configured to selectively unlock a locking element of an EAS tag when the EAS tag is placed in a detachment position defined relative to the detaching element. A control system is arranged, in response to at least one input, to cause the detaching element to transition from a deactivated state, in which the tag in the detachment position will remain locked, to an activated state in which the tag is unlocked. This transition will result in beginning or starting a dwell time. The control system is arranged to maintain the detaching element in the activated state while awaiting receipt from a user interface of a user manually initiated termination signal. The termination signal indicates a user intention to terminate the dwell time. In response to the termination signal, the control system causes the detaching element to transition from the activated state to a deactivated state.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
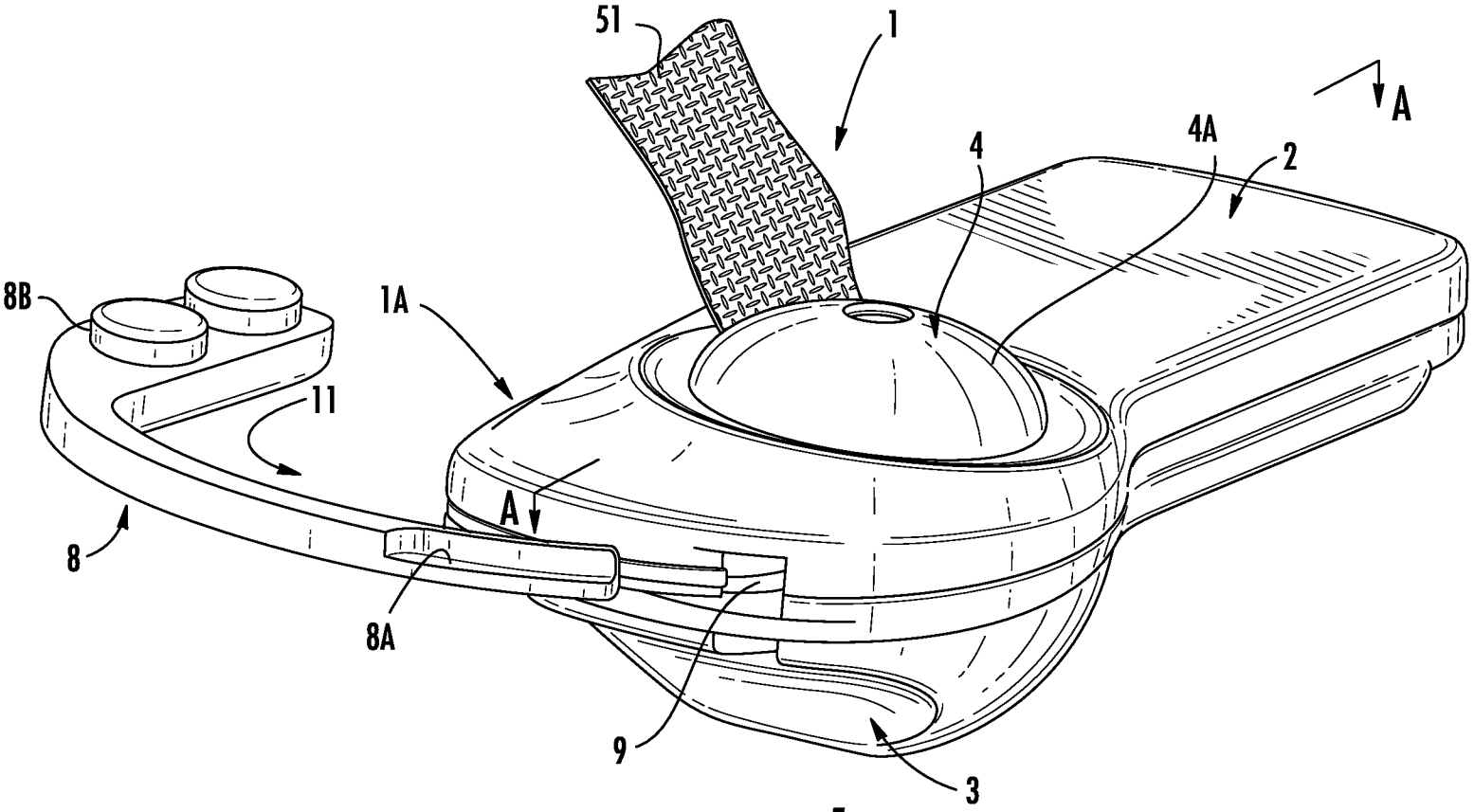
FIG. 1 PRIOR ART
FIG. 1 is an exemplary EAS tag of the prior art that is useful for understanding the inventive arrangements.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The period of time during which a latching mechanism is unlatched by a detacher device to permit removal of an EAS security tag from merchandise is sometimes referred to as a dwell time. During the dwell time, a latching mechanism within an EAS tag is unlatched to facilitate removal of the EAS tag from an article of merchandise. For example, in some EAS tags a pin can be removed from the tag during such dwell time. One problem associated with automatic detacher devices is a high percentage of failed detachment operations. This results in poor user feedback being reported on the performance of the device. The vast majority of perceived "product failures" are merely due to the inability of the user to complete the detachment function using the device (i.e. to remove the pin from the tag) within the timeframe dictated by the preset dwell time. It has been found that many users cannot get into the "rhythm" of the automatic detacher (with a preset dwell time), and as a result, are unable to complete the function properly. When the user "panics" or becomes confused, they typically pull aggressively on the tag to get it out of the unit. his can result in damage to the automatic detacher unit, to the EAS tag, and/or the merchandise to which the tag is attached. The foregoing problem is further exacerbated in scenarios which involve "self-checkout," i.e., where consumers are expected to attend to certain checkout tasks normally handled by store clerks or cashiers. In such scenarios, untrained users cannot be expected to be familiar with the rhythm of the automatic detacher and its preset dwell time.

The invention concerns a method and system for detaching an electronic article surveillance (EAS) tag from an article. The phrase "EAS tag" as used herein broadly includes any type of tag which contains a sensing element now known or known in the future that is useful to facilitate detection or identification of the tag. For example, the EAS tag can include a sensor designed for use in an acousto-magnetic type EAS system. As such, the tag can include a sensor strip of magnetostrictive, ferromagnetic amorphous metal and a magnetically semi-hard metallic strip. An EAS tag as described herein could alternatively include a tag containing a radio frequency identification (RFID) type sensor. Such RFID sensor elements are often used for asset tracking. Sensor elements as noted herein are well known in the art and therefore will not be described here in detail.

The process begins by positioning an EAS tag in a detachment position. In this position, a locking element of the tag is responsive to being unlocked by a detaching element of a tag detaching device. The detaching element can then be caused to transition from a deactivated state (in which the tag in the detachment position will remain locked) to an activated state (in which the tag is unlocked). Once the tag is unlocked, it defines a beginning of a dwell time.

According to one aspect of the invention, a control system can receive from a user interface a user manually initiated start signal indicating a user intention to begin the dwell time. In such a scenario, the transition to the activated state is performed responsive to the start signal received from the user interface. When a user initiated manual start signal is used in this way, it can be advantageous to automatically detect a presence of the tag in the detachment position (e.g., by using a suitable sensor configuration). The detection of the tag can then be used to enable, but not activate, the detaching element. Selectively enabling the detaching element in this way will ensure that the detaching element can transition to the activated state only when the tag is present. If a user attempts to initiate a start signal when the tag is not detected in the detachment position, the user can be alerted with a suitable warning, such as an audible, visual or tactile warning.

The detaching element is maintained in the activated state while awaiting receipt from a user interface of a user manually initiated termination signal indicating a user intention to terminate the dwell time. Thereafter, responsive to the termination signal, the detaching element is transitioned from the activated state to a deactivated state. At this point, the tag can be removed from the detaching position.

According to another aspect of the invention, a control system can cause the detaching element to transition to the activated state automatically responsive to detecting a presence of the tag in the detachment position. In such a scenario, the dwell time can begin automatically, but the termination of the dwell time is exclusively under the control of the user in response to a user initiated control signal from the user interface.

The exact nature of the detaching element can vary in accordance with a particular EAS tag configuration. For certain types of tags, the detaching element advantageously comprises an elongated probe coupled to a motive device. When the detaching device is in the activated state, the motive device under the command of the control system is used to rotate the probe into an interior slot defined within the tag. Subsequently, the control system can cause the probe to be withdrawn from the interior slot when transitioning the detaching element from the activated state to the deactivated state. Other types of detaching elements are also possible, for example, when configured for use with certain types of tags, the detaching element comprises at least one magnet coupled to a motive device. A motive device under the command of the control system moves the magnet toward said tag when the detaching element is in the activated state. As a further alternative, the detaching element could comprises an electromagnet, and the control system could cause an electric current to energize the electromagnet when the detaching element is in the activated state.

Figure 2:
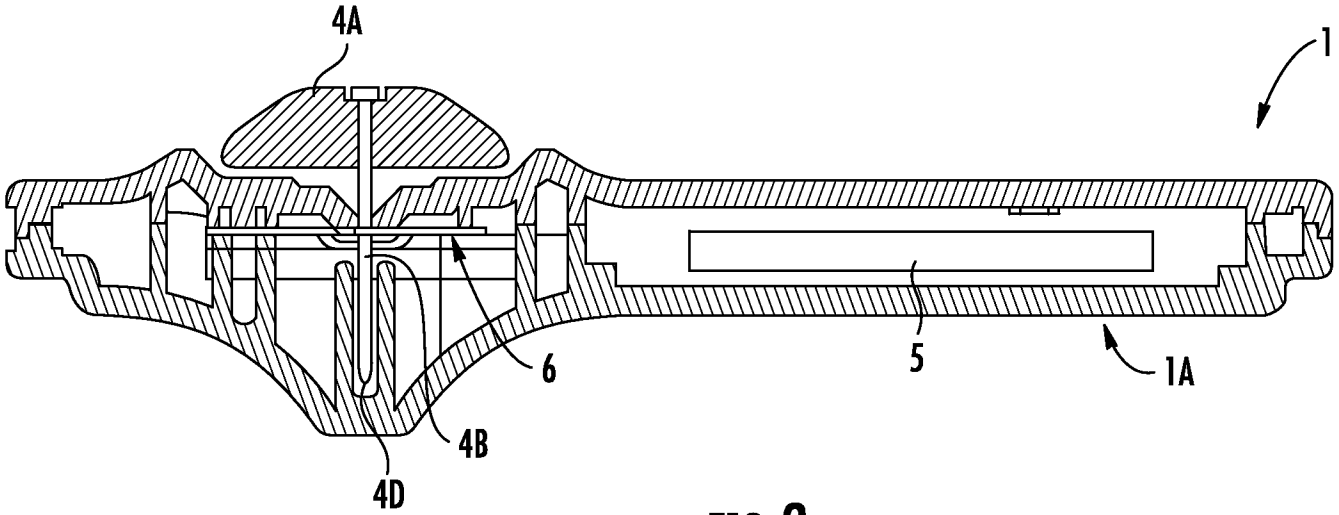
FIG. 2 PRIOR ART
FIG. 2 is a cross-sectional view of the EAS tag in FIG. 1, taken along line A-A.

Referring now to FIG. 1 there is shown a conventional EAS security tag 1 of the prior art. The invention is not limited to use with an EAS security tag 1 as shown, but a brief description of such an exemplary tag is useful for understanding the inventive arrangements. The tag 1 includes an upper housing 2 and a lower housing 3 which are joined along corresponding side walls to form a closed tag body 1A. The tag 1 further includes a tack assembly 4 having an enlarged tack head 4A, an elongated tack body 4B, and a pointed forward end 4D (see, FIGS. 1, and 2). The tack assembly 4 is used to attach the tag body 1A to an article 51 which is to be protected by the EAS tag 1. In order to detect the presence of the tag, an EAS sensor 5 is provided which generates detectable signals. For example the sensor 5 can be an acoustically resonant magnetic sensor. A wide variety of EAS sensors are known in the art and therefore such sensors will not be described here in detail. However, it should be understood that any suitable EAS sensor can be provided in the EAS security tag 1.

The article 51 is joined to the tag body 1A by the tack assembly 4 by inserting the tack body 4B into an opening in the wall of the upper housing 2. When the tack body 45 is fully inserted, the pointed end of the tack is received in an upstanding cavity or collar extending from an inner surface of the lower housing. The tack head 4A, in turn, seats in a recessed area in the upper housing. The article 51 is thus held between the tack head 4A and the housing. A locking element 6 is provided within the tag body for releasably preventing the tack body 4B from being withdrawn from the tag body. The tack assembly 4 and the article 51 thus become releasably locked to the EAS tag 1.

A special arcuate probe 8 is needed to reach and release the locking mechanism inside the security tag and, thus, detach the tack assembly 4 and the article from the tag body 1A. To this end, the tag body 1A is configured so that access to the internal locking mechanism is through an arcuate channel accessible through a curved slot 9 defined by one or more inner walls of the tag body 1A. In order to release the tack 4 from the tag body 1A, the arcuate probe 8 is introduced into the slot opening 9 of the tag body 1A via rotation of the probe about its rearward end 8B. The rotation is indicated by arrow 11 in FIG. 1. This action causes the probe to be inserted within the tag until the forward end 8A of the probe reaches and passes into the inner end of the channel to effect the unlocking operation.

A conventional power actuated detaching assembly of the prior art is configured to automatically insert the probe 8 within a tag body 1A. This action occurs automatically when the tag is placed in a cradle area of a detaching assembly which is specifically designed for unlocking the tack assembly 4 from the tag body 1A. Upon detecting a tag in the cradle area, these devices automatically rotate the probe 8 into position, pause momentarily during a preset dwell time to allow the user to remove the tack assembly from the tag body, and then retract the probe 8 from the body. In such prior art systems, the user must exactly time the manual operations of detachment operation based only on the user's acquired experience with the preset dwell time of the particular device. If the user is not familiar with the timing of these operations, they may attempt to remove the tag during periods other than the dwell time, thereby resulting in damage to the tag and/or detaching assembly.

Although the foregoing problem is particularly noteworthy in a conventional power actuated tag detaching assembly for a tag body 1A as described, the problem described herein is not limited to these types of power actuated tag detaching assemblies. In fact, other types of automatic powered tag detachers for any type of EAS tag can suffer from similar problems. Whenever the tag detacher assembly is arranged to have a preset dwell time which limits the period during which the tag can be released from an article or item of merchandise, the problem is likely to occur because users are not necessarily familiar with the preset dwell time. Notably, the problem described herein is not easily resolved by alerting means for communicating the dwell time to the user. For example, an indicator such an LED that is mounted on the power actuated tag detacher is easily obscured by articles of merchandise (such as clothing) to which the tag is attached. Similarly, an audible alert with respect to dwell time is not suitable for many noisy retail environments. Even if such alerts are provided, they still require new users to become familiar with the rhythm associated with the dwell time in relation to the automated tag detaching process.

In order to overcome the disadvantages of the prior art systems, the inventors have determined an improved hybrid system which combines manual control and automated operations of the power actuated detaching assembly. This hybrid system will allow the user of an automated powered EAS tag detacher to have powered partially automated detachment with manual control of the dwell time. The invention shall be described in relation to an EAS tag 1 and a detacher which is specifically designed for such tags. However, it should be understood that the scope of the invention as described herein is not intended to be limited to any particular type of EAS tag or its associated detacher. Other types of EAS tags which rely on preset dwell times for other types of unlocking mechanisms can be implemented using the inventive arrangements described herein. As an example, tag detachers that use magnets or other types of mechanical systems for effecting tag detachment can also benefit from the inventive arrangements as described. In fact, the inventive arrangements can be used in any type of powered tag detacher that relies on preset dwell times which effectively limit the period during which a locking element (such as a tack assembly 104) can be removed from the tag.

Figure 3:
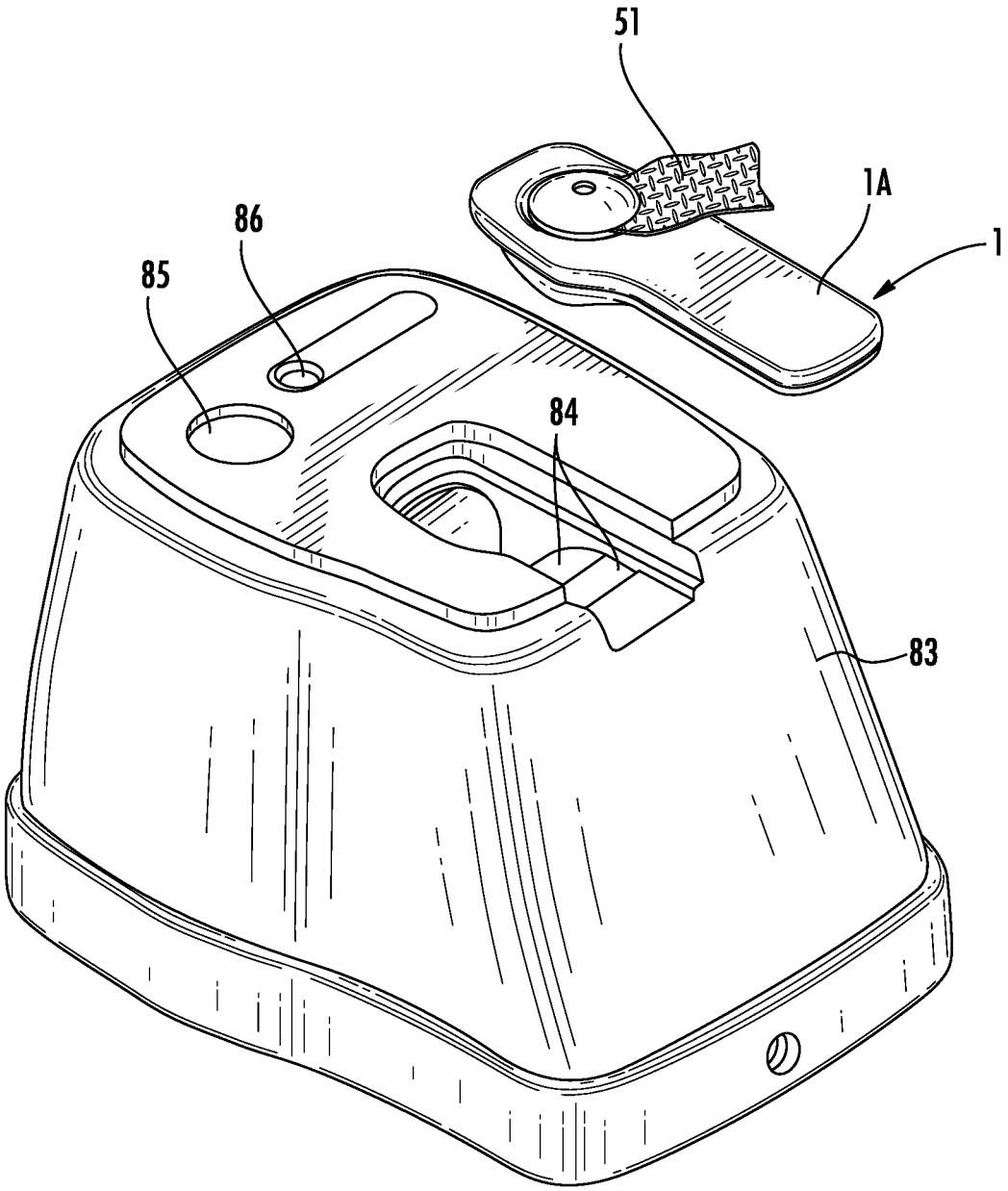
FIG. 3 is a perspective view of a housing or cover of an EAS tag detacher assembly shown with an EAS tag being inserted into a detachment position.
Figure 4:
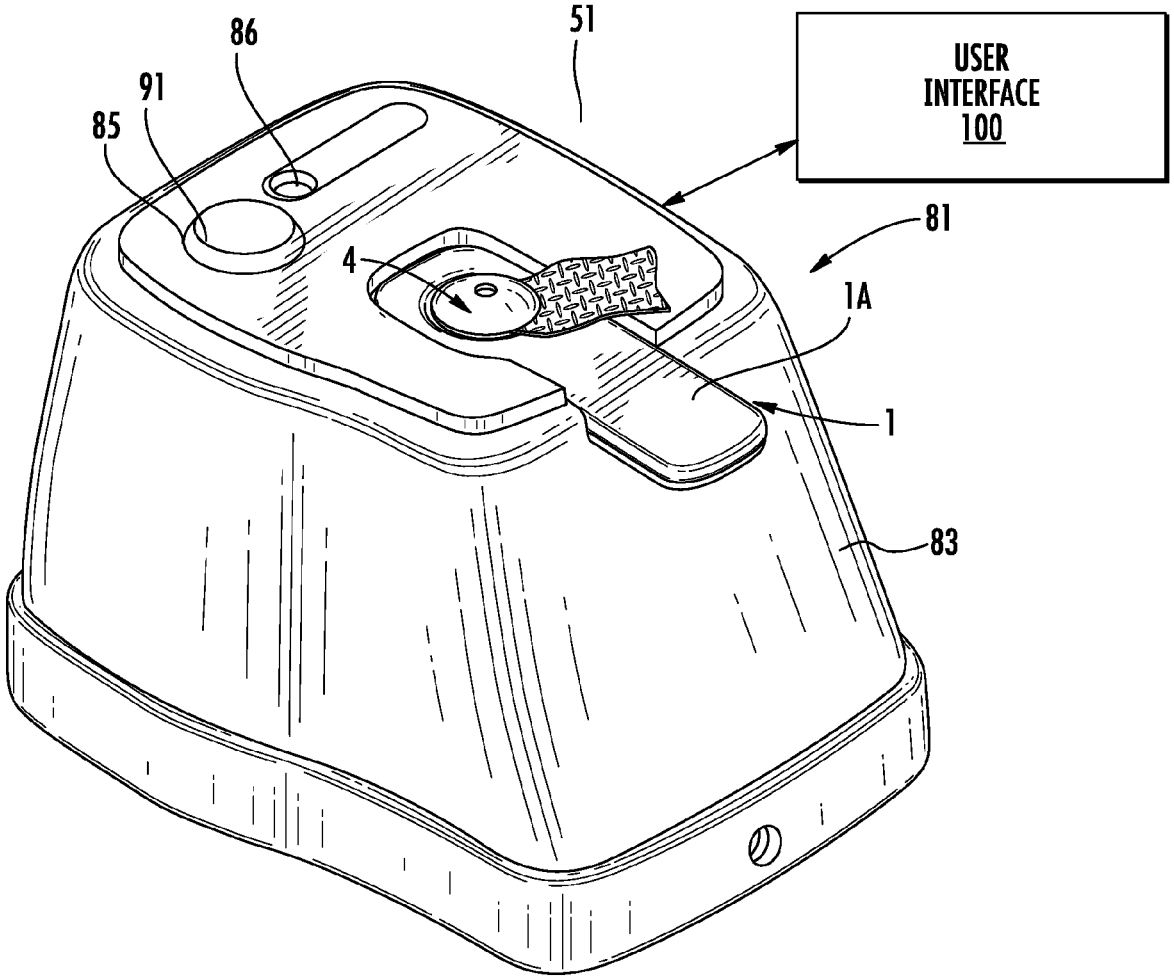
FIG. 4 is a perspective view of an EAS tag detacher assembly in which an EAS tag has been inserted into a detachment position.
Figure 5:
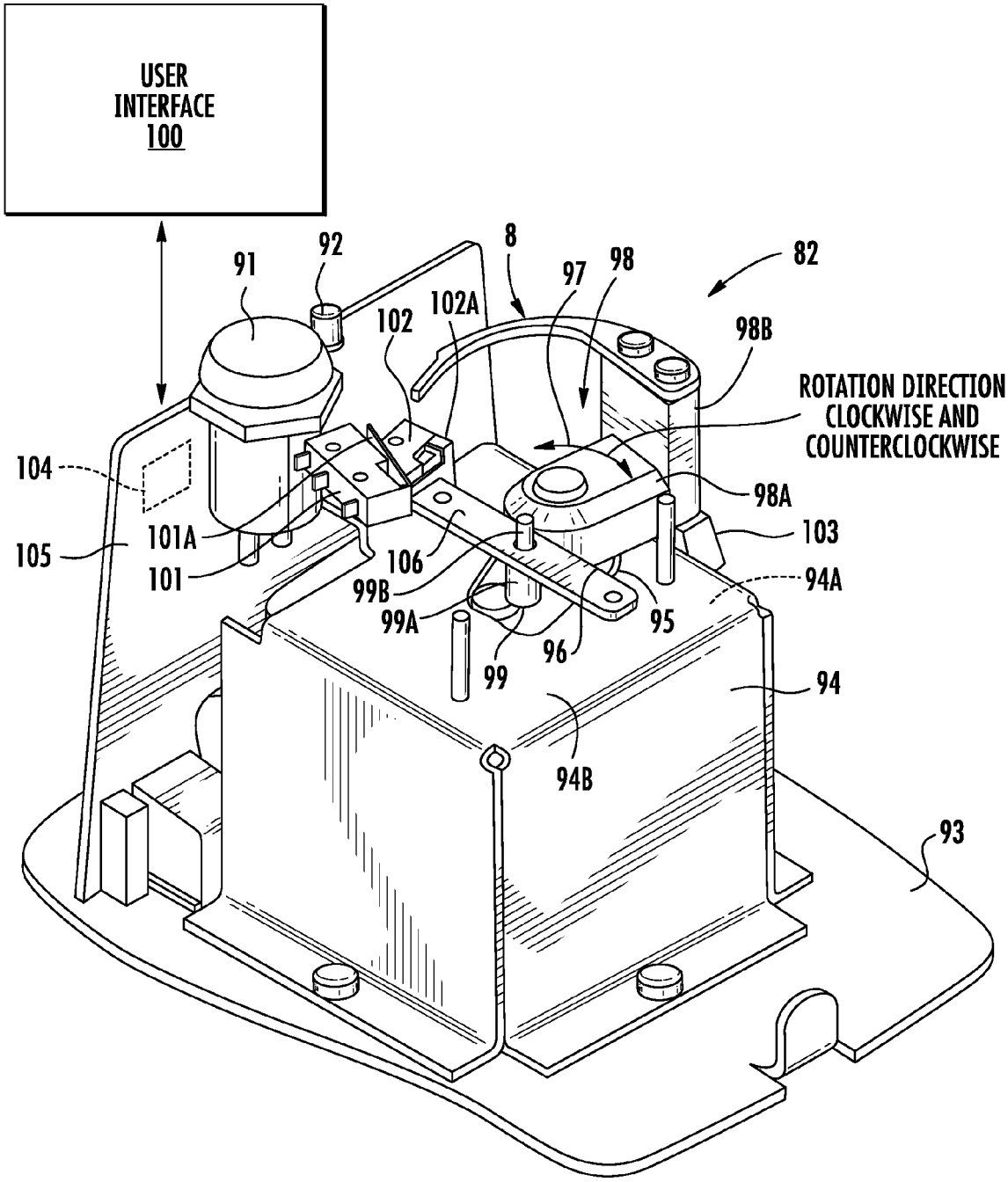
FIG. 5 is a perspective view of a detachment mechanism contained within the housing or cover of FIG. 3 and which is useful for understanding the invention.

Referring now to FIGS. 3-5 there are shown various components of a hybrid automated power operated detaching assembly which is useful for understanding the invention. Since the assembly is designed for detaching EAS tags of the type shown in FIGS. 1 and 2, the detaching assembly incorporates an arcuate detaching probe 8 as previously described. Other types of detaching assemblies within the scope of the present invention may have different mechanisms for effecting the detaching operation. Accordingly, the detacher assembly shown is only one possible example of a detacher that could be used in accordance with the inventive arrangements described herein.

Referring now to FIGS. 3-5, a detaching assembly 81 can include a detaching element for detaching the tack 4 from the tag 1. The detaching assembly 81 is a power actuated assembly and includes a removable detacher cover 83 (as shown in FIG. 3) and a detaching mechanism 82 (as shown in FIG. 5). As shown in FIG. 3, the detacher cover 83 includes a nesting or cradle area 84 for receiving the tag body 1A of the tag 1. The cradle area defines a detachment position in which the tag can be detached by the detaching assembly 81. More particularly, when in the detachment position, a locking a locking element of the tag is responsive to being unlocked by a detaching element of a tag detaching assembly. The cover 83 also includes an ON/OFF switch aperture 85 sized to accommodate an ON/OFF switch 91 of the detaching mechanism 82. A further aperture 86 of the cover 83 receives a light emitting diode (LED) 92 which indicates an operating condition of the detaching mechanism.

As shown in FIG. 5, the detaching mechanism 82 includes a frame or bottom plate 93 to which is affixed a motor cover 94 having in its upper surface 94B an opening 95. The motor cover 94 houses a motor 94A supported on the plate 93. The motor 94A drives an upstanding shaft 96 which projects out of the opening 95 and is rotatable in either a clockwise or counterclockwise direction as desired (indicated by arrows 97). A rotatable member 98 has a base 98A which is fixedly attached to an upstanding section 98B. The base 98A is coupled to the shaft 96 and it and the upstanding section 98B rotate with the rotation of the shaft. The upstanding section 98B carries the rearward end 8B of the arcuate elongated probe 8 and rotation of the section 98B causes rotation of the probe 8, as above-described. In the detaching mechanism 82 a detaching element includes at least the motor and the arcuate elongated probe.

The detaching mechanism 82 is provided with first and second motor enable switches 99 and 101, a position sensor switch 102 and a home switch 103. These switches provide signals over lines (not shown) to control electronics 104 mounted on a PC board 105 attached to the base 93. The control electronics 104, in turn, provide drive signals to the motor 94A for driving same to realize movement of the probe arm 8.

As shown, the motor enable switch 99 is mounted on the upper surface 94B of the motor cover 94 and includes a body 99A which supports a platform element 106. A spring biased upstanding plunger 99B of the switch 99 extends from the body 98A through the platform element 106 and movement of the plunger 99B downward causes activation of the switch 99. The second motor enable switch 101 is also mounted to the motor cover 94, but at the forward end of the platform element 106. The switch 101 includes an outwardly extending reed element 101A which when engaged causes activation of the switch.

When the tag 1 is properly mounted in the cradle area 84 of the cover 83, both the plunger 99B of the switch 99 and the reed element 101A of the switch 101 become engaged. This results in simultaneous activation of both the switches 99 and 101, causing simultaneous motor enable signals to be present at the control electronics 104. The control electronics recognizes this enabled condition as signifying that a tag 1 is properly situated in the detacher assembly and creates a condition under which the motor 94A can be activated. At this point, the motor can be activated responsive to a user input. For example, the user input can be provided by means of a user interface 100 which shall be described below in further detail. In the detaching mechanism 82, the rotation of the motor in a counterclockwise direction can move the probe 8 counterclockwise from its initial position. This rotation will cause the probe to extend into the cradle area 84 and move into the tag body 1A as described above.

The position sensor switch 102 is affixed to the motor cover 94 and has a reed element 102A extending toward the base 98A. The reed element is positioned to be engaged by the base 98A when the counterclockwise moving probe 8 reaches its detachment position, i.e., its position as shown in FIG. 6A. Activation of the position sensor switch by engagement of the reed element 102A causes a further signal to be received by the control electronics 104, indicating that the probe 8 is in position for effecting disengagement of the locking mechanism in an EAS tag 1 which is mounted in the cradle area 84. This is also a signal that the motor rotation should be automatically temporarily stopped. The control electronics 104 recognizes this position as one of maximum extension for the probe 8 and will cause the motor to remain in this position until a further input signal is received from the user interface 100. At a time indicated by a signal from the user interface 100, the control electronics 104 will control a motor drive signal to cause the probe 8 to withdraw from the tag body. The motor drive signal will cause the motor direction to be reversed for purposes of withdrawing the probe from the tag body. This causes the base 98A and section 98B to be clockwise rotated, likewise clockwise rotating the probe 8 bringing it out of the tag and back to its initial or starting position.

The home switch 103 is affixed to the motor cover 94 adjacent the upstanding section 98B. As the base 98A and upstanding section 98B are clockwise rotated, a reed element (not shown) on the switch 103 is engaged by the base 98A as the probe 8 returns to its initial position. This results in the home switch 103 signaling the control electronics 104 that the probe 8 has reached this position. The control electronics 104 then adjusts the drive signals to the motor so that the motor rotation stops and the probe 8 is brought to rest at the initial position.

The user interface 100 can include any suitable electronic, elecro-optic or electro-mechanical arrangement which is capable of generating control signals responsive to a user input for controlling the detaching mechanism 82. However, the user interface is advantageously arranged so that the user input is manually affected by the user independent of any user operations associated with tag positioning and/or removal in a detaching device. As such, a user interface as described herein would not include a tag sensing switch associated with a detaching mechanism that is arranged to automatically initiate a powered tag detaching operation responsive to positioning a switch in a cradle of a detaching device.

An exemplary user interface 100 as described herein could involve a computer touch screen, a foot pedal switch, a counter-mounted push button switch, or an electro-optical sensor activated by a user. Other alternative for user interface 100 can include a point of sale device. The user interface 100 can have a wired or wireless connection to the control electronics associated with the detachment mechanism. Any such user interface arrangement is acceptable provided that it is activated by the user independent from any user initiated tag positioning operation. In its simplest form, the user interface 100 can be a switch that opens and closes in response to a user input. For example, pressing on a foot-pedal switch can initiate motor operation in a counter-clockwise direction when an EAS tag has been previously positioned in the cradle 84. After motor operation has been initiated, the probe 8 will begin rotating from its initial position and will eventually stop in its fully counter-clockwise rotated position as described above. At this point the tack assembly 4 can be detached or disengaged from the tag body 1A, and any attached item or article can be removed from the tag. For example, the user can manually remove the tack from the tag and the article so that the article is released from the tag.

The probe 8 will remain in its fully counter-clockwise rotated position (detaching position) during a dwell time which is controlled by the user. The dwell time begins when the user first signals the control electronics by manual operation of the user interface 100. The end of the dwell time is signaled to the control electronics by a second manual operation of the user interface 100. For example, the second manual operation of user interface can involve the user manually opening the foot-switch or generating some other suitable control signal with the user interface. This signal can indicate to the control electronics 104 that the motor should be initiated once again to rotate the probe in a clockwise direction to withdraw the probe 8 from the tag. From the foregoing, it will be appreciated that the powered detacher described herein is essentially a hybrid detacher system in which certain aspects of the detaching operation are automated and certain aspects are manually controlled. Consequently, the advantages of powered, automated detaching are achieved while also giving the user full control over the dwell time.

Figure 6:
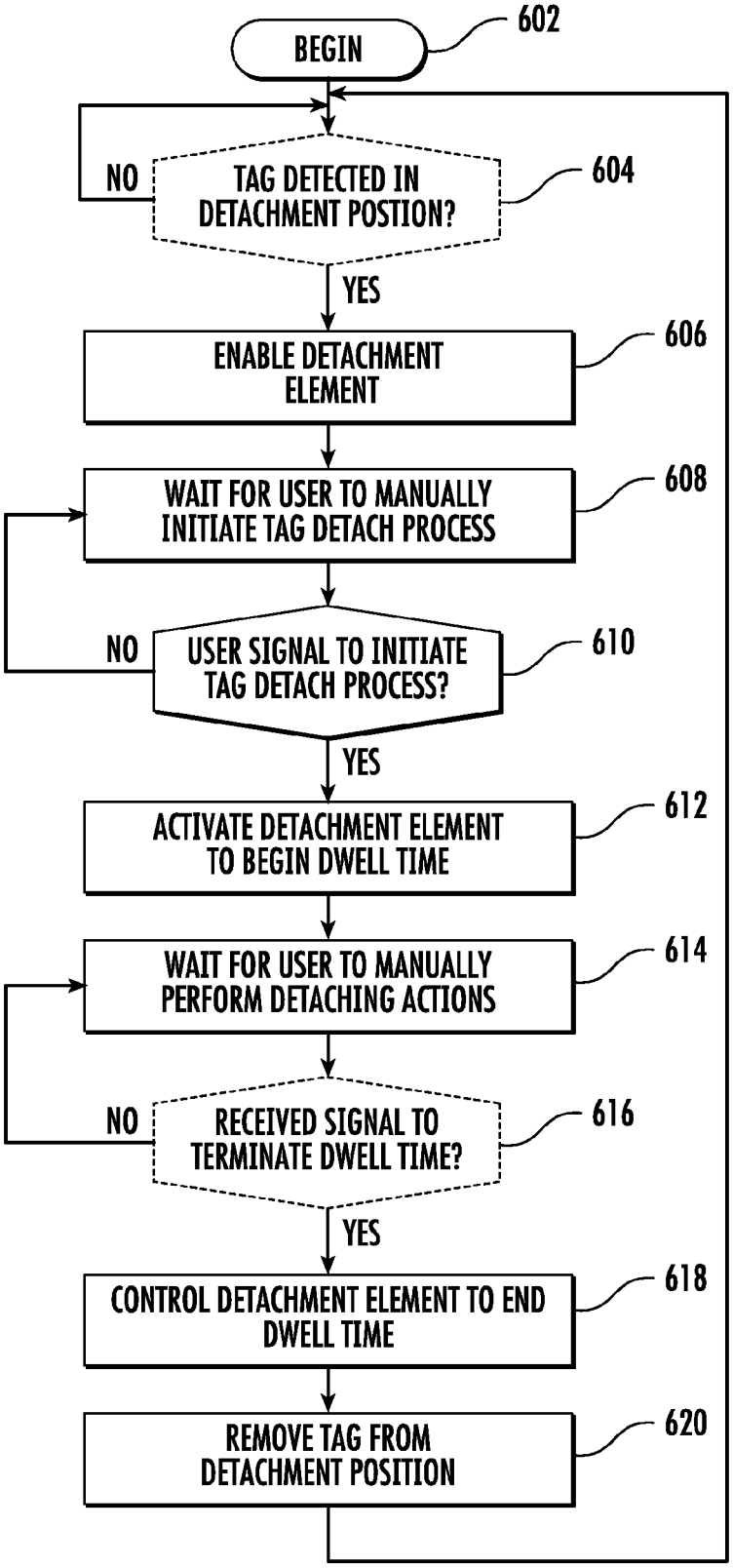
FIG. 6 is a flowchart that is useful for understanding the invention.

Turning now to FIG. 6, a flowchart is provided that is useful for understanding the inventive arrangements. The process shown in FIG. 6 can begin at 602 and continues to step 604 where control electronics (e.g. control electronics 104) associated with a detachment mechanism (e.g., detaching mechanism 82) determines if an EAS tag (e.g. EAS tag 1) has been positioned in a detachment position. The detachment position can be an area such as cradle area 84, but the invention is not limited in this regard. Other types of tags and their associated detachers may not require that the tag be place in such a cradle. It will be appreciated that some detachment positions may not require direct physical contact between an EAS tag and a detachment mechanism. This could occur, for example, in the case of a detacher that uses a magnetic force to effect detachment. In such a scenario, detection of the tag in the detachment position can be achieved by any suitable means. For example, detection in such a scenario can be accomplished using a magnetic sensor, an optical sensor, or an RFID reader, without limitation. For purposes of the present invention, any position on, in or spaced a certain proximate distance relative to a portion of the detacher mechanism can be considered a detachment position, provided that the tag can be detached from an article when located in such position.

If a tag is not detected at 604 (604: No) then the detachment mechanism continues to monitor for the presence of a tag in the detachment position. However, if an EAS tag is detected (604: Yes) then the detachment mechanism will enable (but not activate) the necessary components for effecting detachment. For example, in FIGS. 3-5, the motor 94*a* can be enabled for operation but will not be activated. The process continues on to step 608 where the detachment mechanism continues to wait for a user to manually signal the initiation of the tag detachment process. At 610 a decision is made as to whether a user initiated control signal has been received to indicate the initiation of the tag detachment process. If not (610: No), the system continues to wait for the use initiated input signal. However, if the user initiated control signal is received (610: Yes) then the process continues on to step 612. In the exemplary detacher shown in FIGS. 3-5, the user initiated control signal can be provided by means of a user interface 100 as previously described.

Once a user initiated control signal has been received at 610, the process continues on to 612 at which point a detachment element is activated. The precise nature of the activation can vary depending upon the particular type of EAS tag to be detached and the particular detaching mechanism. For example, in the detaching mechanism 82 the activation would involve activating the motor 94*a* to cause rotation of the probe 8. When the motor reaches its fully counter-clockwise rotation position in which the probe 8 is fully inserted in the tag body 1A, the dwell time will begin. But the inventive arrangements can extend to other types of tags and detaching mechanisms and so activation of the detachment element can be different in different tag detachment scenarios. For example, if a particular tag requires application of a magnetic force to detach such tag, then the activation of the detachment element in step 612 could involve moving a magnet into position or activating an electromagnet to begin the dwell time. Many different types of tags and detachment mechanisms are well known in the art and therefore the various activations required for each such detacher will not be described here in detail. However, it should be understood that the inventive arrangements can extend to any tag and its associated detacher which is now known or known in the future.

Regardless of the particular type of detachment mechanism, the process will continue on to 614 where the control electronics will briefly wait for a user to manually perform the detaching actions for detaching the tag from a particular article or item of merchandise. In step 616 the control electronics associated with the detaching operations will determine whether a user initiated signal has been received which indicates that the dwell time for the detachment process has ended. If not (616: No) then the process returns to step 614. However, if a user initiated control signal is received the process continues on to 618 where the control electronics controls the detachment element to cause an end to the dwell time. For example, in the exemplary detacher shown in FIG. 5, this step can involve activating the motor 94A in a reverse direction so as to cause the probe to rotate in a clockwise direction and return to its initial position. The dwell time in this scenario essentially ends when the probe is no longer engaged with the tag 1 in such a way as to facilitate detachment operations. Of course, the actions required for termination of the dwell time at 618 will depend on the particular tag arrangement and detaching mechanism in use. For example, if the detaching operation involves moving a magnet into proximity with the tag, then the termination of the dwell time can involve activating a motor or solenoid to move the magnet away from the tag. Other scenarios are also possible. For example, if an electromagnet is initially excited with an electric current to begin the dwell time at 612, then step 618 can involve switching off an electric current applied to the electromagnet to end the dwell time. Once the dwell time has ended, the tag can be removed from the detacher assembly at 620. For example, this can be a manual process in which the user removes the tag from the detacher. Once the tag is removed, the process can return to step 604 for processing the next tag.

Figure 7:
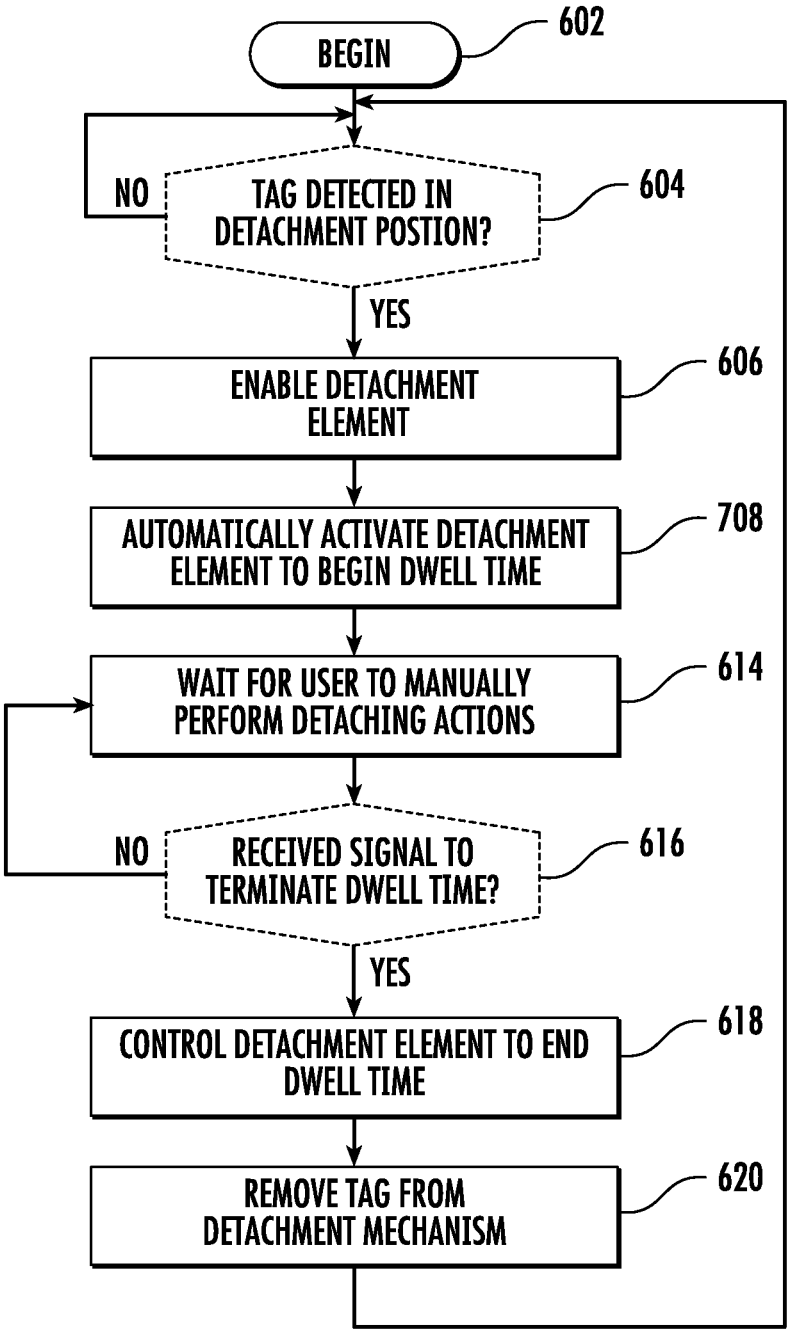
FIG. 7 is a flowchart that is useful for understanding an alternative embodiment of the invention.

In an alternative embodiment of the invention shown in FIG. 7, a similar process can involve steps similar to those recited in FIG. 6, with the exception that steps 608-612 are replaced by step 708. In step 708 a tag detacher can automatically initiate a dwell time for tag detachment. The remaining steps are the same as in FIG. 6 such that a user retains control over when the dwell time is terminated. This alternative embodiment has many of the same advantages as the process described in FIG. 6 (i.e. user control of dwell time), except that the initiation of the dwell time is handled automatically instead of manually.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

We claim:

1. A method for detaching an electronic article surveillance (EAS) tag from an article, comprising:

positioning an EAS tag in a detachment position in which a locking element of the tag is responsive to being unlocked by a detaching element of a tag detaching device;

causing the detaching element to transition from a deactivated state in which the tag in the detachment position will remain locked, to an activated state in which the tag is unlocked to begin a dwell time;

maintaining the detaching element in the activated state while awaiting receipt from a user interface of a user manually initiated termination signal indicating a user intention to terminate the dwell time;

responsive to said termination signal, transitioning the detaching element from the activated state to a deactivated state; and removing the tag from the detaching position.

2. The method according to claim 1, further comprising:

receiving from the user interface a user manually initiated start signal indicating a user intention to begin the dwell time; and wherein the transition to the activated state is performed responsive to the start signal.

3. The method according to claim 2, further comprising:

automatically detecting a presence of the tag in the detachment position, and responsive to the detecting, enabling but not activating, said detaching element to selectively permit said detaching element to transition to said activated state when said start signal is received.

4. The method according to claim 1, further comprising:

automatically detecting a presence of the tag in the detachment position, and performing the transition to the activated state automatically responsive to the detecting.

5. The method according to claim 1, wherein said detaching element comprises an elongated probe coupled to a motive device, and wherein the method further comprises rotating said probe with said motive device into an interior slot defined within said tag when said detaching element is in the activated state.

6. The method according to claim 5, further comprising withdrawing said probe from the interior slot using said motive device when transitioning the detaching element from the activated state to the deactivated state.

7. The method according to claim 1, wherein the detaching element comprises at least one magnet coupled to a motive device, and wherein the method further comprises moving said magnet with the motive device toward said tag when said when said detaching element is in the activated state.

8. The method according to claim 1, wherein the detaching element comprises an electromagnet, and wherein the method further comprises applying an electric current to energize the electromagnet when the detaching element is in the activated state.

9. A system for detaching an electronic article surveillance (EAS) tag from an article, comprising:

a detaching element configured to selectively unlock a locking element of an EAS tag when the EAS tag is placed in a detachment position defined relative to the detaching element;

a control system arranged to in response to at least one input, cause the detaching element to transition from a deactivated state, in which the tag in the detachment position will remain locked, to an activated state in which the tag is unlocked, said transition resulting in a start of a dwell time;

maintain the detaching element in the activated state while awaiting receipt from a user interface of a user manually initiated termination signal indicating a user intention to terminate the dwell time; and in response to said termination signal, cause the detaching element to transition from the activated state to a deactivated state.

10. The system according to claim 9, wherein the control system is further arranged to receive from the user interface a user manually initiated start signal indicating a user intention to begin the dwell time, and wherein the control system is responsive to receipt of the start signal to cause the detaching element to transition to the activated state.

11. The system according to claim 10, further comprising:

further comprising at least one sensor coupled to the control system to facilitate automatically detecting a presence of the tag in the detachment position, and wherein the control system is responsive to the detecting for enabling, but not activating, said detaching element;

and wherein said detaching element is in arranged to transition to said activated state when said start signal is received exclusively when enabled.

12. The system according to claim 9, further comprising:

at least one sensor coupled to the control system and configured to automatically detect a presence of the tag in the detachment position, wherein the control system is responsive to detecting the presence of the tag to automatically cause the transition to the activated state.

13. The system according to claim 9, wherein said detaching element comprises an elongated probe coupled to a motive device, and wherein the detachment position is arranged so that the elongated length of the probe is moved into an interior slot defined within said tag when said detaching element is in the activated state.

14. The system according to claim 13, wherein the control system is configured to cause the motive device to automatically withdraw said probe from the interior slot when the detaching element is transitioned from the activated state to the deactivated state.

15. The system according to claim 9, wherein the detaching element comprises at least one magnet coupled to a motive device, and wherein the motive device is configured to move the magnet toward the tag when the detaching element is in the activated state.

16. The system according to claim 9, wherein the detaching element comprises an electromagnet, and wherein the control system is configured to cause an electric current to energize the electromagnet when the detaching element is in the activated state.

* * * * *